US005169156A

United States Patent [19]

Smollar

[11] Patent Number: 5,169,156

[45] Date of Patent: Dec. 8, 1992

[54] INTERACTIVE ACTION TOY SYSTEM

[75] Inventor: Marvin Smollar, Northbrook, Ill.

[73] Assignee: Marchon, Inc., Arlington Heights, Ill.

[21] Appl. No.: 654,745

[22] Filed: Feb. 13, 1991

[51] Int. Cl.[5] ..... A63H 17/02

[52] U.S. Cl. ..... 273/312; 446/6

[58] Field of Search ..... 273/312, 311, 86 B; 446/6, 446, 4

[56] References Cited

U.S. PATENT DOCUMENTS

| | | | |
|---|---|---|---|
| 1,235,771 | 8/1917 | Dettra | 446/4 X |
| 2,205,941 | 6/1940 | Clark | 446/446 |
| 2,308,524 | 1/1943 | Longnecker | 446/4 X |
| 2,519,298 | 8/1950 | Thorp | 446/4 |
| 2,562,648 | 7/1951 | Sparrow | 273/311 |
| 3,206,122 | 9/1965 | Frisbie et al. . | |
| 3,510,631 | 5/1970 | Weinberg et al. . | |
| 3,734,500 | 5/1973 | Cooper | 446/6 X |
| 4,082,220 | 4/1978 | Cheng et al. . | |
| 4,091,945 | 5/1978 | Barlow et al. . | |
| 4,232,865 | 11/1980 | Chen et al. | 273/311 |
| 4,508,521 | 4/1985 | Klimpert et al. | 446/4 X |
| 4,938,483 | 7/1990 | Yavetz | 273/312 X |

FOREIGN PATENT DOCUMENTS

| | | | |
|---|---|---|---|
| 721475 | 6/1942 | Fed. Rep. of Germany | 446/441 |

*Primary Examiner*—William H. Grieb

*Attorney, Agent, or Firm*—Laff, Whitesel, Conte & Saret

[57] ABSTRACT

A new interactive action toy system is provided in which two travelling toys interact to produce an observable event. A first travelling toy has engaging means for interacting with a second travelling toy, and the second travelling toy has means responsive to the engaging means on the first travelling toy for precipitating an observable event associated with the second travelling toy. The second travelling toy may include a second engaging means for interacting with a second responsive means on the first travelling toy for precipitating an observable event associated with the first travelling toy. The observable event may be a change in position or release of a member associated with said second or first travelling toys or an auditory or visual signal. The travelling toys may operate on tracks, such as slot tracks, or may travel freely such as by a wireless control on land, water or a cushion of air. The travelling toys may be in the form of a toy car, truck or airplane or an action figure such as a soldier, horse or robot.

43 Claims, 6 Drawing Sheets

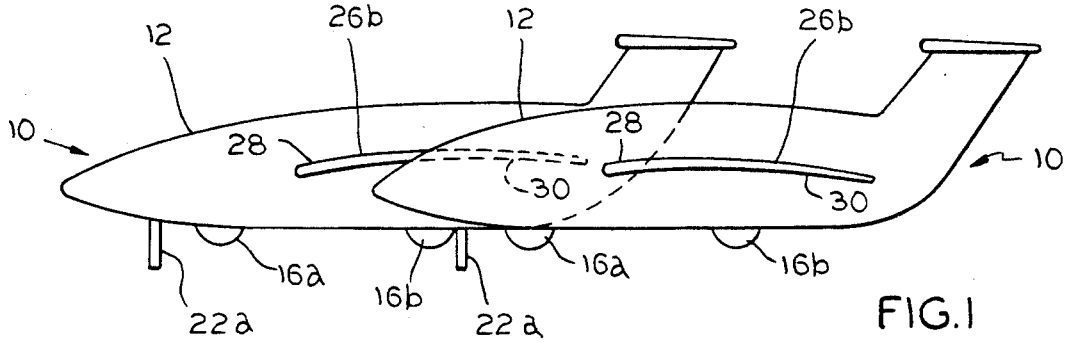
FIG.1
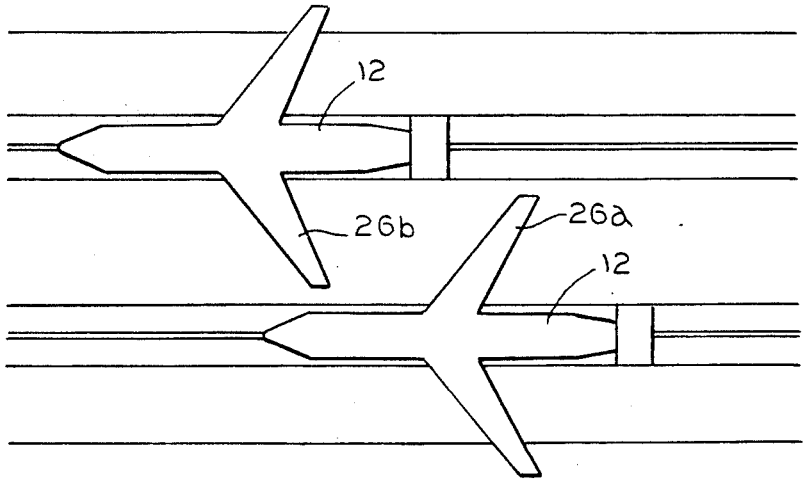
FIG.1A
FIG.1B
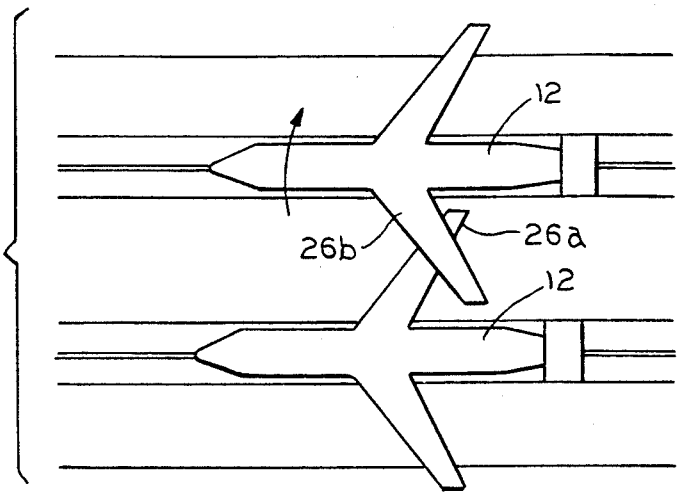

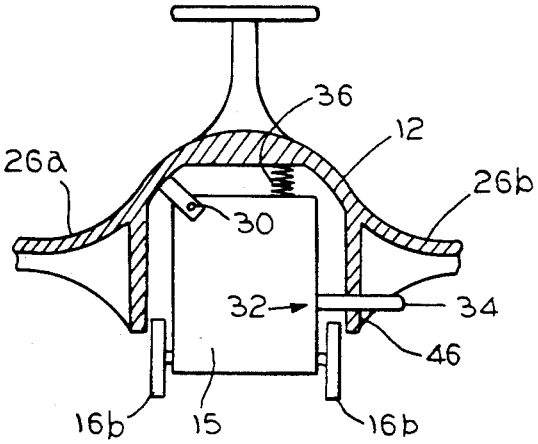
FIG.5
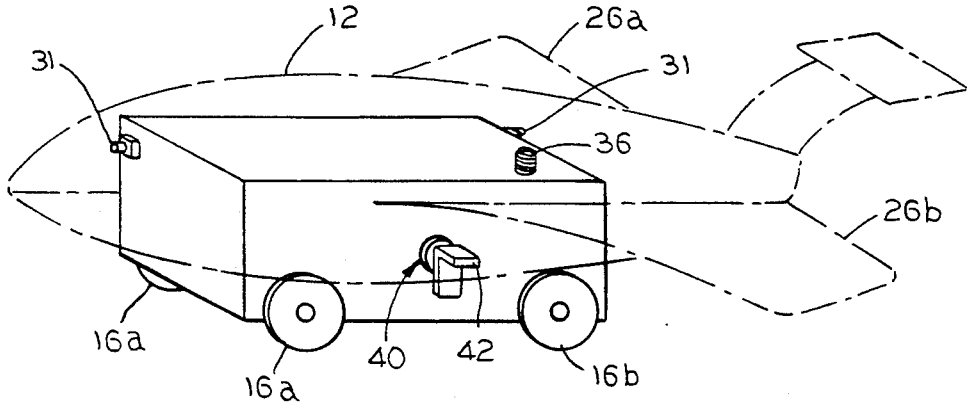
FIG.6
FIG.7
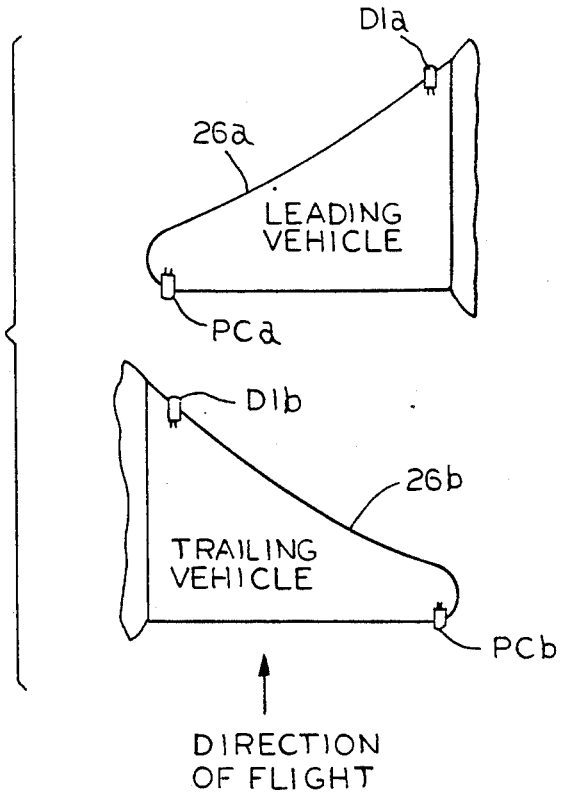

INTERACTIVE ACTION TOY SYSTEM

FIELD OF THE INVENTION

This invention relates to a new field of toys. More particularly, this invention relates to new toy systems including at least two travelling toys which interact to produce an observable event.

BACKGROUND OF THE INVENTION

Numerous types of travelling toys are available in the marketplace, including, for example, toy cars which operate on and off tracks. In the case of the track toys, there are often two or more tracks which parallel each other so that players may race their cars against each other.

While toy cars and vehicles are generally of interest to many children in imaginative play, being able to race cars substantially expands the interest and excitement of such toys to many children, particularly as they advance in age and skill. However, there often comes a point when the child grows tired of play with toy cars and similar vehicles, even toy cars which are adapted to be raced against each other. Accordingly, it is desirable to provide novel features which will renew and prolong interest in such toys by enhancing the competitive challenge and excitement which they present.

SUMMARY OF THE INVENTION

Accordingly, an object of this invention is to provide a travelling toy system in which at least two travelling toys physically interact to precipitate an observable event.

Another object of the invention is to provide a travelling toy system in which at least two travelling toys are adapted to physically interact to release a member from one of the travelling toys.

Another object of the invention is to provide a track system which can simulate some aspects of an aerial dogfight, or the like. In this connection, an object is to provide a track system which enables a vehicle controlled by one player to pursue (a pursuing vehicle) and shoot down a vehicle controlled by another player (a fleeing vehicle).

Yet a further object of the present invention is to provide a toy system in which at least two vehicles which travel in or on water are adapted to physically interact to precipitate an observable event.

These and other objects of the present invention will become apparent to those skilled in the art upon consideration of the accompanying specification, claims and drawings.

The present invention primarily entails an interactive action toy system having at least two travelling toys. The first travelling toy has engaging means designed to interact with the second travelling toy. The second travelling toy is adapted to respond to the engaging means to precipitate an observable event associated with the second travelling toy.

Just about any travelling toy, adapted for generally linear movement, can be used in the practice of the invention. For example, toy vehicles such as toy cars and toy trucks can be used, whether motorized or designed to move by the application of external forces such as by pushing or by the force of gravity. The toy vehicles may operate on tracks, such as slot tracks consisting of a plurality of connected track segments which have one or more slots that parallel the length of the track. In such systems, each toy vehicle has a protruding pin which fits into the slot to guide the vehicle as it travels on the track. When the slot vehicle is motorized, tracks with conductive rails parallel to the slot are used to supply power to an electronic motor in the vehicle to propel it along the track. A few examples of such slot track systems are found in U.S. Pat. Nos. 3,206,122; 3,510,631; 4,082,220; and 4,091,995.

Other types of toy vehicles operating on tracks which may be used in the practice of the invention include toy cars and trucks adapted to be operated free of pins and slots on a track having upstanding sidewalls which confine the vehicle to the track. Alternatively, useful travelling toys include toys which run on rails, such as conventional toy trains and monorail trains which may hang down from the rail rather than rest upon it.

The travelling toys need not operate on a track at all. For example, they may be motorized cars, operated without a track either by way of a hard-wired control or with a wireless control. Indeed, such trackless toys may also be motorless and operated simply by pull-strings in the hands of the child operators. The travelling toys need not be vehicles in the conventional sense, but may be, for example, action figures such as soldiers, warriors, policemen, or athletes adapted to be travelling as well as toy horses or toy chariots adapted to be moved on wheels and optionally carrying riders or drivers who are designed to be thrown therefrom in accordance with the present invention. Finally, toy vehicles which travel on a cushion of air, like hovercraft, or by way of magnetic flux interaction, such as futuristic trains and cars presently under development, but which are substantially equivalent to travelling vehicles for present purposes could also be used. Furthermore, toy vehicles which travel on or in water may also be used in the practice of the invention.

In one embodiment of the invention at least one travelling toy is adapted to respond to the engaging means of another travelling toy to effect a change in position of a releasable member. The releasable member can be a member which is ejected or released from the second travelling toy, such as a car body, an airplane body or wing, a rider on a horse, a car or truck driver, a pilot, and so on. The releasable member can also be an indicator which is movably affixed to the travelling toy, such as a flag which moves into view as the engaging means of another travelling toy interacts with the travelling toy carrying the flag.

Alternatively, one travelling toy may include an indicator which produces either a visual or an auditory signal in response to engaging means of another travelling toy in accord with the invention. For example, a bell or buzzer sound, or a light, such as an LED signal or a spark, could be produced.

The engaging means for the observable event can be, for example, a projection or a cavity on one travelling toy which is positioned to push, pull, cam or unlatch a releasable member on another travelling toy. It could also be a light which is designed to trigger a photocell associated with appropriate circuitry for freeing the releasable member on the other vehicle. The choices are varied and many, depending on the specific application.

Where the observable event comprises a change in position of a releasable member of the second travelling toy, the releasable member may be maintained in place, for example, by gravity, by friction, or with a magnet. Alternatively, it can be spring-loaded on the toy and held in place by a latch adapted to be released upon interaction with the engaging means. In any event, the releasable member may be disengaged free and clear of the travelling toy or it may be attached to the toy with, for example, a hinge or a string.

Finally, the travelling vehicles may each carry both the engaging means and the responsive means, so that either vehicle could be maneuvered into position to precipitate an observable event in association with the other.

BRIEF DESCRIPTION OF THE DRAWINGS

The features of this invention which are believed to be novel are set forth with particularity in the appended claims. The invention, together with its objects and advantages, may be best understood by reference to the following description taken in conjunction with the accompanying drawings, in which like reference numerals identify like elements in the several figures and in which:

FIG. 1 is a side elevation view of two toy airplanes as corresponding wings of the two aircraft come into contact;

FIGS. 1*a* and 1*b* are top views of the two airplanes of FIG. 1 as one overtakes and then engages the other;

FIG. 5 is a front elevation view, partially in cross section, of an alternative embodiment of one of the toy airplanes of FIG. 1;

FIG. 6 is a perspective view of a toy airplane with an electrically controlled latch showing the airplane fuselage in broken lines;

FIG. 7 is a schematic representation of a light-photocell configuration for photoelectric interaction between two toy airplanes;

DESCRIPTION OF THE PREFERRED EMBODIMENTS

Figure 2:
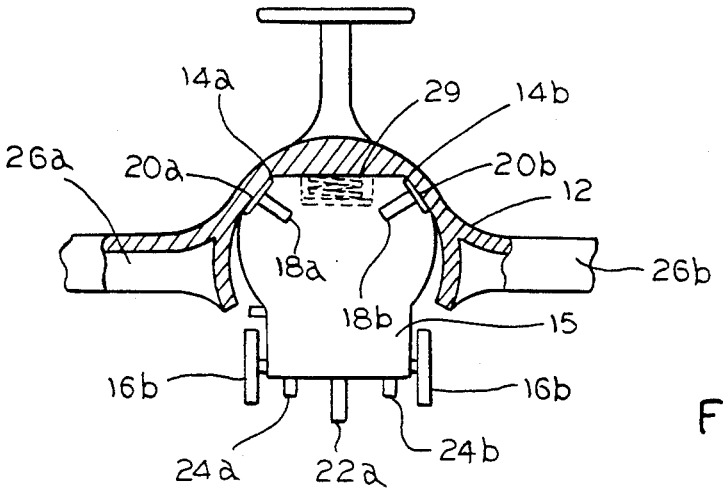
FIG. 2 is a front elevation view, partially in cross section, of one of the airplanes of FIG. 1.

While preferred embodiments of the present invention are described below in connection with wheeled toys, such as toy airplanes (with wheels) adapted to run on slotted tracks, mono-rail trucks, chariots, and boats, this invention is intended to encompass all travelling toys including, for example, hovercraft, magnetic flux driven trains and cars, etc., as well as boats and other vehicles designed for travelling in and on water. Thus, use of the term "travelling" throughout the specification and claims should be understood to include such equivalent structures that do not employ wheels.

FIGS. 1–4 show travelling toys 10, each consisting of a toy airplane fuselage 12 frictionally fit at points 14*a* and 14*b* to a chassis 15 which contains a miniature AC electric motor (not shown) and drive wheels 16*b*. Alternatively, the fuselage may be held in place by positioning magnets 18*a* and 18*b* in the chassis 15 opposite metallic straps 20*a* and 20*b* on the fuselage.

In addition to drive wheels 16*b*, fuselage 12 has a forward wheel or wheels 16*a*. Pins 22*a* and 22*b* project downwardly from the vehicle and are adapted to fit into and be guided by a slot in a track. A pair of electrical springs or sliding shoe contacts 24*a* and 24*b* are carried by the vehicle chassis to slide over electrically energized rails on the slot track to power the electric motor.

Fuselage 12 includes wings 26*a* and 26*b* projecting outwardly on either side of the vehicle. The wings each include a leading top surface 28 for engaging a trailing bottom surface 30 of the wing 26 of an adjacent toy airplane, as explained in greater detail below in connection with FIGS. 1*a*–1*b*, 3*a*–3*c* and 4*a*–4*c*.

Figure 3C:
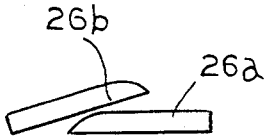
FIGS. 3*a*–3*c* are schematic representations of the engagement of the wings of the airplanes of FIG. 1, as the rearward airplane advances on the forward airplane.
Figure 3B:
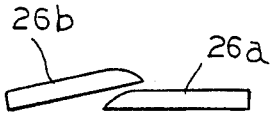
Figure 3A:
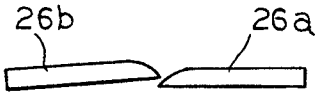
Figure 4C:
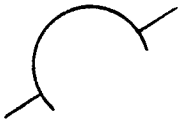
FIGS. 4*a*–4*c* are front elevation schematic representations of the fuselage and wings of the forward airplane of FIG. 1.
Figure 4B:
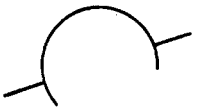
Figure 4A:
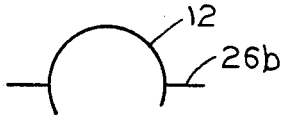

Thus, FIG. 3*a* shows, in schematic representation, a front view of a wing 26*a* of a first airplane and a front view of a wing 26*b* of a second airplane, when the wing tips first interact as the trailing airplane overtakes the leading airplane. The sequential interaction of the wings is illustrated in FIGS. 3*b* and 3*c* as well as in corresponding top and front schematic views of the fuselage and wings of the second airplane in FIGS. 1*a*–1*b* and 4*a*–4*c*. Thus, as wing 26*a* of the first airplane moves under wing 26*b* of the second airplane, it progressively cams wing 26*b* upward. This camming action enables the overtaking vehicle to force the fuselage 12 from chassis 15, simulating a "kill" by the overtaking vehicle. The disengagement of the fuselage from the chassis 15 may be enhanced by inserting an optional spring 29, shown in broken lines in FIG. 2, which is compressed when the fuselage is frictionally or magnetically held to the chassis.

In alternate embodiments, fuselage 12 may be replaced by a toy auto or truck body or by any other releasable member which is freed from the supporting chassis by a camming action similar to that described in connection with FIGS. 1–4.

In yet another alternate embodiment, illustrated in FIG. 5, fuselage 12 is hinged at 30 to chassis 15. Element 32 is a latch and spring combination similar to latches found in many low cost, ball point pens. That is, if pushbutton 34 is pushed once, the fuselage is latched to the chassis 15 in a normal position (FIG. 2). If pushbutton 34 is pushed a second time, fuselage 15 is released from the chassis. When the fuselage is released, spring 36 causes fuselage 15 to swing on the hinge 30 to a "shot-down" position. After the vehicle is "shot-down", the child manually pushes the body down over the vehicle chassis thereby operating pushbutton 34 and again latching the body in position. Any of many different means may be provided on the other airplane to engage button 34, such as a bumper (not shown) protruding laterally from the fuselage of the other airplane.

In FIG. 6, an electrically controlled latch 40 replaces the mechanical push button 34 of FIG. 1. Normally, a spring (not shown) pushes the latch 42 outwardly far enough to engage slot 46 in fuselage 12 and thus to latch it to the chassis. When energized, an electromagnet (not shown) retracts the latch far enough to escape slot 46. When this happens, spring 36 causes the body to tip to the "shot down" position.

FIG. 7 shows wings 26*a* and 26*b* of fleeing and pursuing vehicles, respectively. Each vehicle has a light emitting diode (LED) D1 at a convenient location on its wing. A photocell PC is positioned on the wing of the fleeing vehicle to receive the light from the LED of the pursuing vehicle. Thus, as shown, the diode D1*b* on the pursuing vehicle wing 26*b* is lighting the photocell PCa on the fleeing vehicle wing 26*a*. This light informs the vehicle as to whether it is the fleeing or the pursuing and attacking vehicle. In a simple structure, a circuit may be closed when the LED lights the photocell PC in order to energize magnet 42 and thereby flip the body to a "shot down" position.

Figure 8:
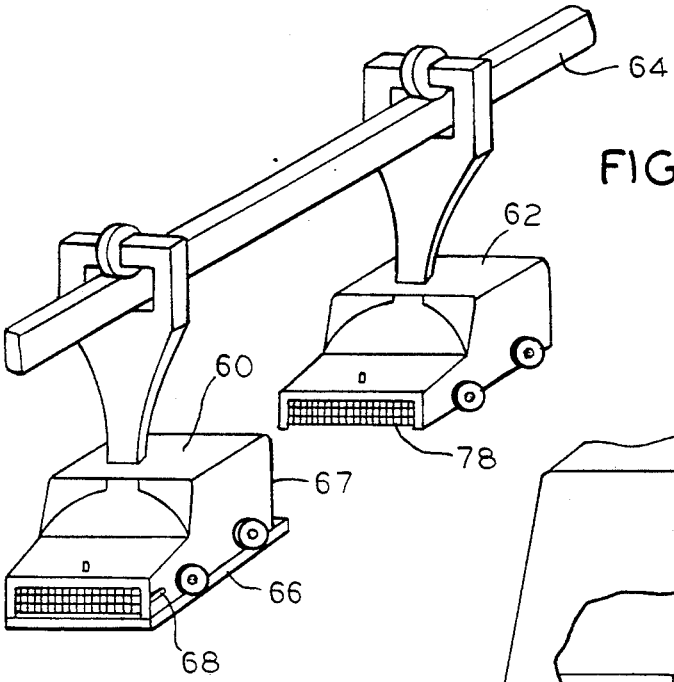
FIG. 8 is a perspective view of an embodiment of the invention comprising two toy trucks adapted for interaction, riding on a monorail.
Figure 8A:
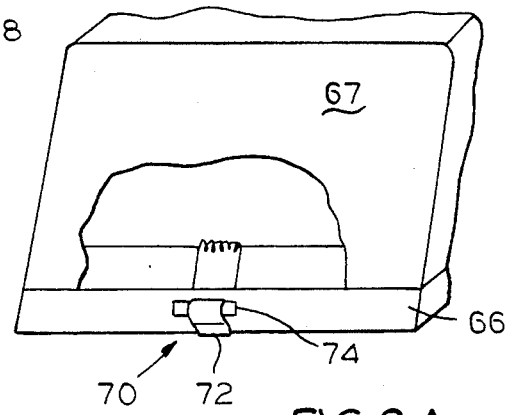
FIG. 8*a* is an enlarged partial view of the rear of the forward toy truck of FIG. 8 showing the latch mechanism holding the bottom member of the truck in place.

FIG. 8 illustrates trucks 60 and 62, running on monorail 64. Truck 60 includes a lower member 66, hinged at 68 to the bottom of the truck. Member 66 is held in its closed position by a latch 70, which is illustrated in FIG. 8A, a partial enlarged view of the rear 67 of truck 60 cut away to reveal the latch details.

Latch 70 includes a spring loaded catch 72 which, in its normal closed position, is spring biased against opening 74 in the rearward edge of lower member 66. When monorail truck 62 catches up with monorail truck 60, the grill 78 of truck 62 drives the catch from opening 74 permitting member 66 to swing open about hinge 68 under the force of gravity. A parachute-equipped toy character or other item can be stored on member 66, so that the character or other object falls from the forward truck, signalling a successful contact.

The hinged moveable member may be positioned in other locations on the vehicle, such as the front or either side, to permit release upon contact between vehicles approaching from opposite directions or approaching along adjacent monorails.

Figure 9:
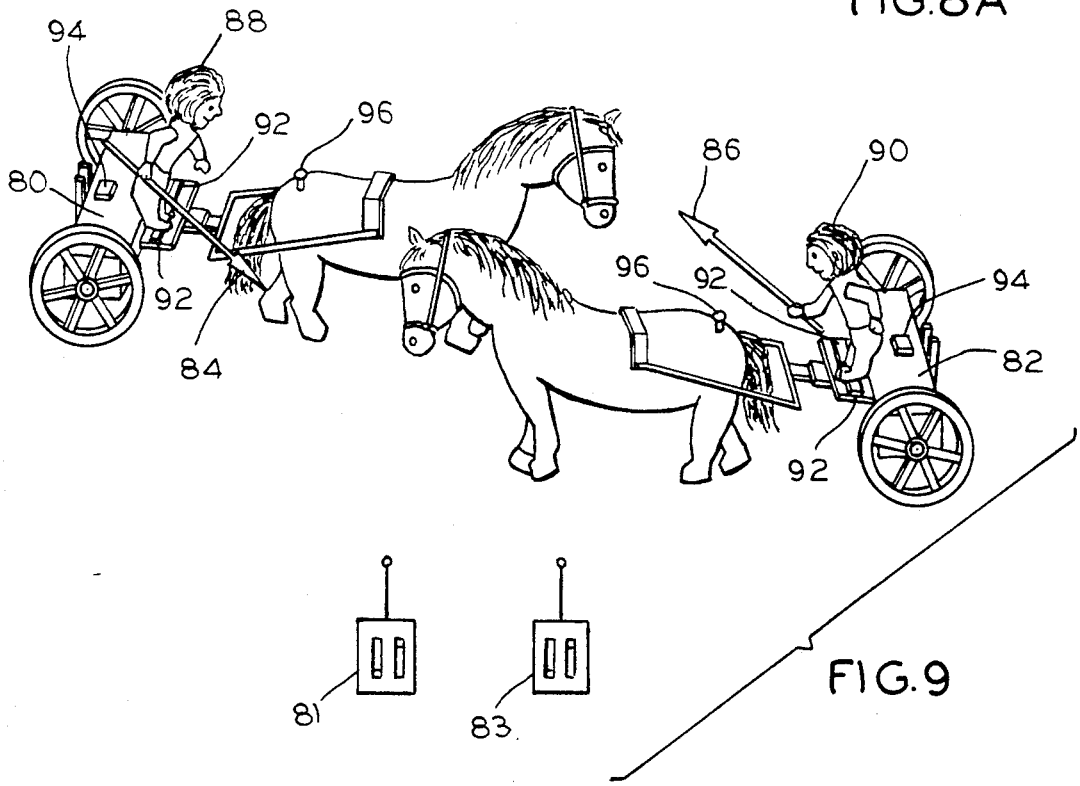
FIG. 9 is a perspective view of two remote controlled chariots adapted for release of the chariot drivers upon interaction between the chariots in accordance with the invention.

FIG. 9 show two motorized remote control chariots 80 and 82, 82, controlled by wireless remote controls 81 and 83. In this case, each of the travelling toys has both engaging means in the form of lances 84 and 86 and responsive means in the form of toy warriors 88 and 90 standing in the respective chariots. Thus, the children controlling each of the two chariots direct them in juxtaposition and simultaneously control movement of the lances and the chariots in an effort to either push or pull each other's chariot driver from his chariot. In an alternative embodiment, the chariot drivers could be spring loaded into position in the chariots and adapted to be ejected from the chariots when the opposing player's lance strikes a hair-trigger latch holding the driver in place. Additonally, the drivers could be fitted with contact strips 92 such that, when standing in the chariot, the contact strips complete an electrical circuit and when the drivers are either knocked out of place or ejected, the circuit opens causing, by way of the appropriate circuitry (not shown) a signal of an effective hit. This signal is pictured as both an audible signal at buzzer 94 and a visual signal at blinking light 96.

Figure 10A:
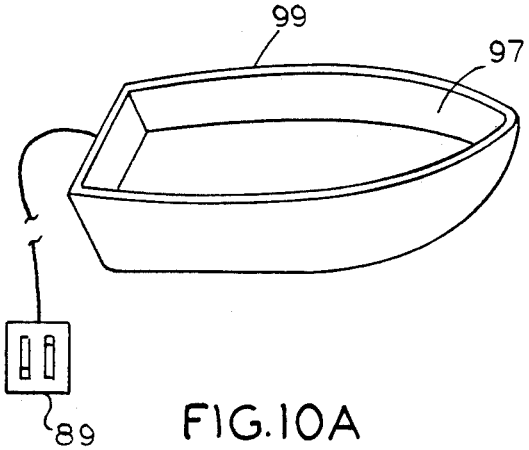
FIGS. 10A and 10B are of two boats, operated by remote control, in which one boat is adapted to sink upon interaction with the other.
Figure 10B:
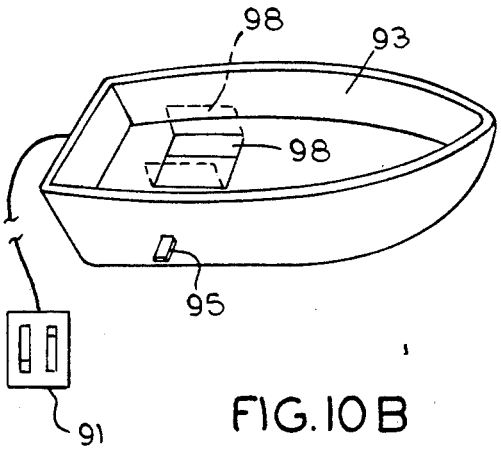

FIGS. 10A and 10B illustrate two toy boats, operated by hard-wired remote controls 89 and 91, afloat and ready for action. Boat 90 includes a hair-trigger latch 92, which, when contacted by the hull 94 of the other toy boat 96 instantaneously releases a hatch 98 in the bottom of the boat 90 causing it to sink.

Figure 11:
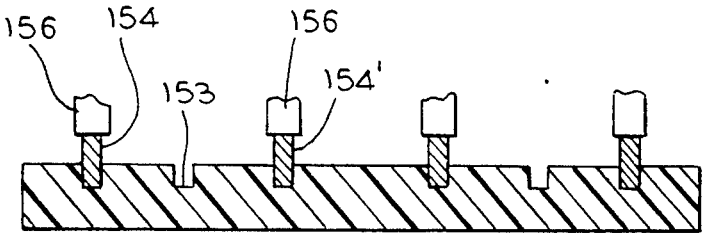
FIG.11 (PRIOR ART)
FIG. 11 is a cross-section of a conventional prior art slot track.

FIG. 11 shows a cross-section of a conventional slot track. The dependent pin 22*a* (FIG. 1) fits into a slot 153 to guide and direct the vehicle as it travels around the track. A pair of sliding shoe contacts 24*a*, 24*b* (FIG. 1) ride on individually associated ones of two rails 154, 154' in order to supply power to the vehicle motor. A second and identical track is positioned in a side-by-side relationship to accommodate a second vehicle.

Figure 12:
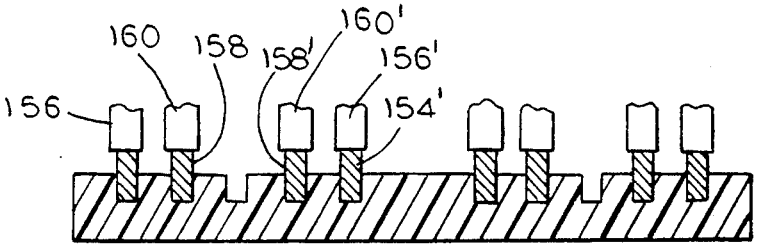
FIG. 12 is a cross-section of a control track section of a slot track.

In FIG. 12, a control track section has two extra rails 158, 158' which may be embedded into a single track section or a plurality of track sections among the sections making up the track lay out. An extra pair of sliding shoes contacts 160, 160' are mounted on the vehicle to slide over the extra rails. An electrical circuit including rails 158, 158' and shoes 160, 160' may be used to control a "shoot down", which is possible only while the two vehicles are on the control track.

Figure 13:
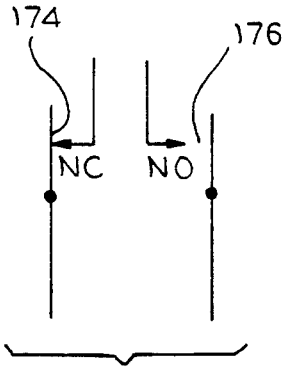
FIG. 13 is a schematic showing of control contacts for the toy using the control track section shown in FIG. 12.
Figure 14:
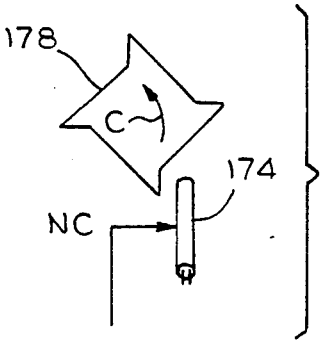
FIG. 14 is a disclosure of a trigger controlled contact for generating a momentary control signal for preventing an opponent from "shooting down" a vehicle controlled by the contacts of FIG. 13.

FIGS. 13, 14 show a trigger controlled set of contacts on a control device used to operate and control the slot track vehicle. The trigger contacts include one set of normally closed (NC) contacts 174 and one set of normally open (NO) contacts 176. One of the contacts (here the normally closed contact 174) may be controlled by a rotation of a star wheel 178. When the trigger is pulled, star wheel 178 rotates in direction C at which time, a tooth on the star wheel momentarily opens normally closed contacts 174. If the device of FIGS. 13, 14 is slightly rearranged, the star wheel 178 may momentarily close the normally open contacts 176.

Figure 15:
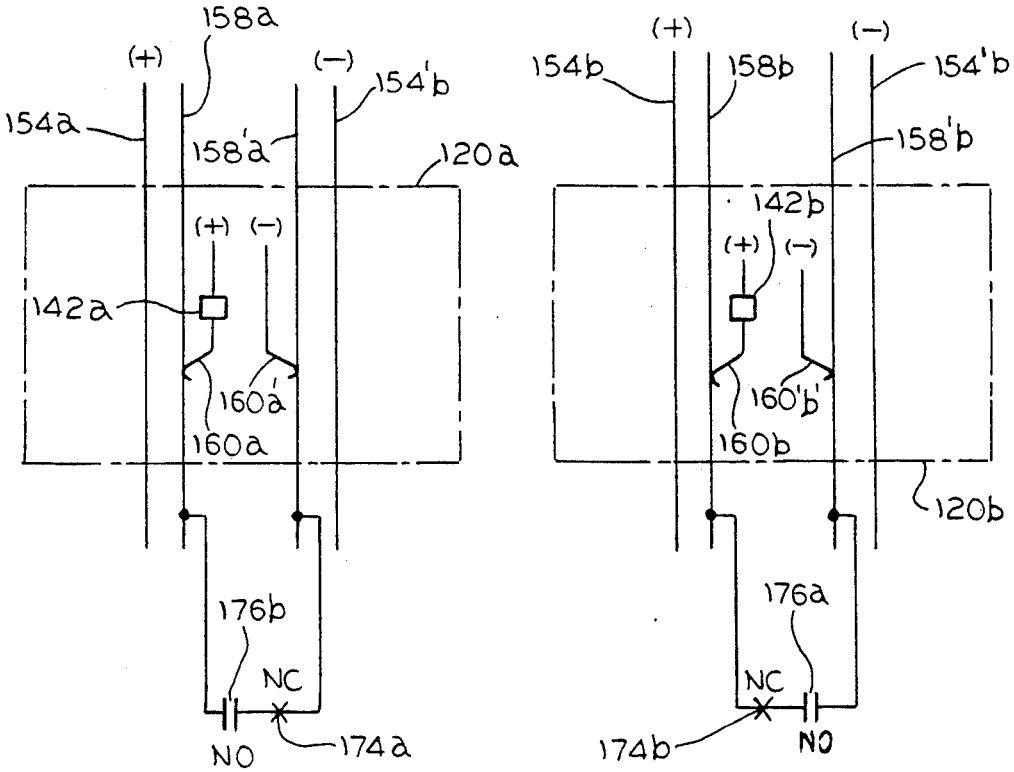
FIG. 15 is a schematic circuit diagram of a structure for sending electrical signals to the control track section.

FIG. 15 shows one embodiment of a slot track control section which uses the four rail control system of FIG. 12 and the trigger controlled contacts of FIGS. 13 and 14. There are two vehicles 120, each with the sliding shoes 156 and 160, as explained in connection with FIG. 12. One of the vehicles and its parts is identified by an addition of the suffix letter "a" to the reference numerals. The other vehicle and its parts are identified by an addition of the suffix letter "b" to the reference numerals. The left rail and associated parts is distinguised from the right rails and associated parts by an addition of a prime "'" mark to the reference numeral in order to identify the right side.

Figure 16:
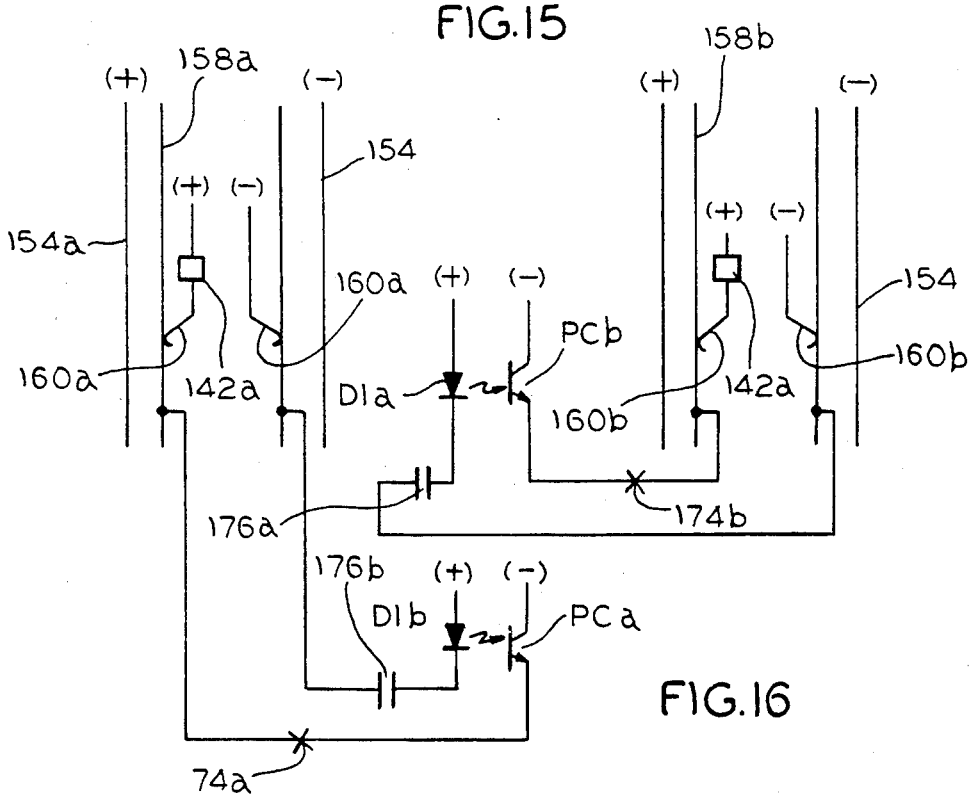
FIG. 16 is another schematic circuit diagram of a structure for sending electrical signals to the control track section and which further includes a light-photocell configuration for distinguishing between pursuing and fleeing vehicles.

Separate batteries are shown by (+) and (−) in FIGS. 15, 16; however, with suitable diodes or other isolation devices, only one battery or power supply is required.

In general, one player may close normally open contacts 176 associated with his opponent's control tracks in order to shoot down the opponent's vehicle. The player may open his own normally closed contacts 174 to defend his vehicle from being shot down. Thus, for example, in the mechanical system (FIG. 15), player "a" may operate his trigger to close normally open contacts 176*a* in a circuit leading to his opponent's release magnet. The circuit may be traced from (+) through body release magnet 142*b*, sliding control shoe 160*b*. control track rails 158*b*, player a's normally open (but now closed) contacts 176*a*, normally closed contacts 174*b*, control rail 158*a'*, and sliding contact shoe 160*a'* to (−). If player "b" can open his normally closed contact 174*b* while the player "a" closes his normally open contacts 176*a*, the magnet 142*b* is not energized. However, if player "b" does not open his contacts 174*b* at this time, magnet 142*b* is energized and the body flips to the position shown in FIG. 4*c*. Since FIG. 15 does not provide a means for distinguishing between leading and trailing positions, either player can shoot down the other's vehicle while both vehicles are on the control track section.

In FIG. 16, the light emitting diode (LED) D and photocell PC of FIG. 7 are included in the circuit in order to identify which vehicle is fleeing and which is attacking. The contacts 176*a*, 174*b* are as described above in connection with FIG. 15. Thus, player "a" controlling a pursuing vehicle may operate his trigger to close the circuit that leads to his light emitting diode Da, the circuit being traced from (+) through contacts 176*a*, control rail 158*a'*, sliding shoe contact 160*a'*, and LED Da to (−). Hence, the LED on the pursuing vehicle lights to shoot a light beam at the fleeing vehicle.

If vehicle "a" is close enough behind vehicle "b", photocell PCb becomes conductive when the LED light falls on it. A circuit may be closed to operate electromagnet 142*b*, the circuit being traced from (+), through photocell PCb (if it is then receiving light from diode Da), magnet 142*b*, sliding shoe 160*b*, control rail 158*b*, and contact 174*b* to (−). If player "b" opens his contact 174*b* while contact 176*a* is closed and diode Da is lit, the circuit to magnet 142*b* is not energized and it does not open the latch. In contrast, if player "b" does not open contacts 174*b*, magnet 142*b* is energized when photocell PCb receives light from LED Da and the body flips. It should be emphasized that the LED of the pursuing vehicle must be close enough to the photocell of the fleeing vehicle to complete the circuit to the release magnet 142 when the normally open contacts close and the normally closed contacts are not open.

Hence, FIG. 15 allows either player to shoot down the other while both of the vehicles are on the control section of the track. It is irrelevant whether one is in front or behind the other. In FIG. 16, not only must the players operate their triggers in a correct manner while both are on the control track, but also, only the pursuing vehicle can shoot down the fleeing vehicle.

While the present invention is described above in connection with preferred or illustrative embodiments, these embodiments are not intended to be exhaustive or limiting of the invention. Rather, the invention is intended to cover any alternatives, modifications or equivalents which may be included within its spirit and scope, as defined by the appended claims.

The invention claimed is:

1. An interactive action toy comprising:

first and second travelling toys;

said first travelling toy having engaging means for physically interacting with said second travelling toy; and said second travelling toy having means responsive to said engaging means for precipitating an observable event associated with said second travelling toy as said toys travel alongside each other.

2. The interactive action toy of claim 1 wherein said travelling toys are chosen from the group consisting of toy cars, toy trucks, toy boats, toy airplanes, toy trains, and toy horses.

3. The interactive action toy of claim 1 in which at least one of said travelling toys is motorized.

4. The interactive action toy of claim 1 in which said travelling toys are adapted to move in response to an application of external forces.

5. The interactive action toy of claim 1 in which said first and second travelling toys are vehicles adapted for travel on a track.

6. The interactive action toy of claim 5 in which said track is a slot track.

7. The interactive action toy of claim 6 in which said interactive action toy includes a slot track.

8. The interactive action toy of claim 5 in which said track is a monorail.

9. The interactive action toy of claim 8 in which said interactive action toy includes a monorail.

10. The interactive action toy of claim 9 in which said travelling toys are adapted to hang from said monorail.

11. The interactive action toy of claim 5 includes a track having upstanding sidewalls for limiting lateral movement of said travelling toys.

12. The interactive action toy of claim 1 wherein said first and second travelling toys are motorized and operable by remote control.

13. The interactive action toy of claim 12 in which said remote control is hard-wired.

14. The interactive action toy of claim 12 wherein said remote control is wireless.

15. The interactive action toy of claim 1 wherein said responsive means includes a releasable member and said observable event comprises a change in position of said releasable member relative to said second travelling toy.

16. The interactive action toy of claim 15 in which said releasable member comprises a projectile which separates completely from said second travelling toy.

17. The interactive action toy of claim 15 in which said releasable member is hinged to said second travelling toy.

18. The interactive action toy of claim 15 in which said releasable member comprises an indicator movably affixed to said second travelling toy.

19. The interactive action toy of claim 15 wherein said engaging means precipitates separation of said releasable member from said second travelling toy upon physical interaction with said responsive means.

20. The interactive action toy of claim 19 wherein said engaging means is adapted to push said releasable member to separate said releasable member from said second travelling toy.

21. The interactive action toy of claim 20 in which said engaging means is adapted to push said releasable member from said second travelling toy by a camming action which lifts said releasable member from said second travelling toy.

22. The interactive action toy of claim 19 in which said engaging means separates said releasable member from said second travelling toy by a pulling action which pulls said releasable member from said second travelling toy.

23. The interactive action toy of claim 15 wherein said releasable member is friction fit on said second travelling toy.

24. The interactive action toy of claim 15 wherein said releasable member is spring loaded to said second travelling toy.

25. The interactive action toy of claim 15 wherein said releasable member is held in place by a magnet.

26. The interactive action toy of claim 15 wherein said releasable member is held in place by a latch adapted to be released by said engaging means.

27. The interactive action toy of claim 1 in which said responsive means comprises means for signalling.

28. The interactive action toy of claim 27 in which said signalling means comprises an indicator movably affixed to said second travelling toy.

29. The interactive action toy of claim 27 in which said signalling means is adapted to produce a sound.

30. The interactive action toy of claim 27 in which said signalling means is adapted to produce a visual signal.

31. The interactive action toy of claim 1 wherein said engaging means and said responsive means physically interact as said travelling toys approach each other from opposite directions.

32. The interactive action toy of claim 1 wherein said engaging means and said responsive means physically interact as said first travelling toy approaches the second travelling toy as the travelling toys travel in the same direction.

33. The interactive action toy of claim 1 wherein said second travelling toy includes second engaging means for physically interacting with said first travelling toy and said first travelling toy include second responsive means for physically interacting with said first travelling toy.

34. An interactive action toy comprising:

first and second toy vehicles adapted to run on a track, said first toy vehicle having engaging means for physically interacting with said second toy vehicle, said second toy vehicle having means responsive to said engaging means for precipitating an observable event associated with said second toy vehicle, and said responsive means including a releasable member, said observable event comprising a change in position of said releasable member relative to said second toy vehicle and said engaging means pushing said releasable member from said second toy vehicle by directly camming said releasable member to lift said releasable member from said toy vehicle.

35. An interactive action toy comprising a slot track assembly with toy vehicles wherein there are at least two vehicles for travel around a slot track, said vehicles each including a vehicle chassis from which a pin depends and fits into and is guided by a slot in the track, said vehicles further including a pair of electrically conductive springs that are carried by the vehicle chassis to slide over electrically energized rails in the slot track to power said toy vehicles, said assembly comprising means associated with each of the vehicles for indicating when each vehicle has been shot; and means associated with each of the vehicles for shooting the other of said vehicles.

36. The interactive action toy of claim 35 including means associated with each of said vehicles for defending against being shot.

37. An interactive action toy comprising:

first and second travelling toys;

said first travelling toy having engaging means for physically interacting with said second travelling toy;

said second travelling toy having means responsive to said engaging means precipitating an observable event associated with said second travelling toy as said toys travel one behind the other; and said responsive means including a releasable member, said observable event comprising a change in position of said releasable member relative to said second toy vehicle and said engaging means pushing said releasable member by directly camming and lifting said releasable member.

38. An interactive action toy comprising:

first and second travelling toys;

said first travelling toy having engaging means for physically interacting with said second travelling toy;

said second travelling toy having means responsive to said engaging means for precipitating an observable event associated with said second travelling toy as said first travelling toy approaches alongside said second travelling toy; and said responsive means including a movable member, said observable event comprising a change in position of said movable member relative to said second toy vehicle and said engaging means pushing said movable member by directly camming and lifting said movable member.

39. The interactive action toy of claim 38 in which said releasable member separates completely from said second vehicle when said engaging means of said first toy vehicle directly cams and lifts said releasable member.

40. An interactive action toy comprising:

first and second travelling toys;

said first travelling toy having engaging means for physically interacting with said second travelling toy;

said second travelling toy having means responsive to said engaging means for precipitating an observable event associated with said second travelling toy as said first travelling toy approaches said second travelling toy from behind said second toy; and said responsive means including a movable member, said observable event comprising a change in position of said movable member relative to said second toy vehicle and said engaging means pushing said movable member by directly camming and lifting said movable member.

41. An interactive action toy comprising:

first and second toy vehicles adapted to run in or on water; said first toy vehicle having an engaging means for physically interacting with said second toy vehicle;

said second toy vehicle having means responsive to said engaging means for precipitating an observable event associated with said second vehicle;

said responsive means including a releasable member; and said observable event comprising a change in position of said releasable member relative to said second toy vehicle to sink said second toy vehicle.

42. The interactive action toy of claim 41 in which said releasable member is hinged to said second vehicle.

43. The interactive action toy of claim 41 in which said releasable member comprises an indicator movably affixed to said second vehicle.

* * * * *